US009878510B2

(12) United States Patent
Wu et al.

(10) Patent No.: US 9,878,510 B2
(45) Date of Patent: Jan. 30, 2018

(54) PRESSING APPARATUS AND STAMP PRESS APPARATUS

(71) Applicant: ScienBiziP Consulting (Shenzhen) Co., Ltd, Shenzhen (CN)

(72) Inventors: Wei Wu, Shenzhen (CN); Chieh-Yu Lee, New Taipei (TW)

(73) Assignee: ScienBiziP Consulting(Shenzhen)Co., Ltd., Shenzhen (CN)

( * ) Notice: Subject to any disclaimer, the term of this patent is extended or adjusted under 35 U.S.C. 154(b) by 538 days.

(21) Appl. No.: 14/590,409

(22) Filed: Jan. 6, 2015

(65) Prior Publication Data

US 2016/0144417 A1 May 26, 2016

(30) Foreign Application Priority Data

Nov. 24, 2014 (CN) ..... 2014 1 0678753

(51) Int. Cl.

| | |
|---|---|
| ***B21D 39/02*** | (2006.01) |
| ***B21J 9/20*** | (2006.01) |
| ***B30B 5/00*** | (2006.01) |
| ***H01R 43/02*** | (2006.01) |
| ***B21J 15/18*** | (2006.01) |
| ***H01R 43/042*** | (2006.01) |
| ***B31F 1/00*** | (2006.01) |
| ***B30B 1/02*** | (2006.01) |

(52) U.S. Cl.

CPC ..... *B30B 5/00* (2013.01); *B21D 39/021* (2013.01); *B21J 15/18* (2013.01); *B30B 1/02* (2013.01); *B31F 1/00* (2013.01); *H01R 43/02* (2013.01); *H01R 43/0427* (2013.01)

(58) Field of Classification Search

CPC .. H01R 43/02; H01R 43/0427; B21D 39/021; B21J 15/18; B30B 1/02; B30B 5/00; B31F 1/00

USPC ..... 72/429

See application file for complete search history.

(56) References Cited

U.S. PATENT DOCUMENTS

| | | | | |
|---|---|---|---|---|
| 2,600,860 A * | 6/1952 | Dupre | H01R 43/0427 | 72/416 |
| 2,865,212 A * | 12/1958 | Fischer | B21J 15/18 | 72/452.8 |
| 6,810,711 B2 * | 11/2004 | Mueller | H01R 43/042 | 72/429 |
| 6,923,036 B1 * | 8/2005 | Stefanek | B21D 39/021 | 29/243.58 |

* cited by examiner

*Primary Examiner* — David B Jones

(74) *Attorney, Agent, or Firm* — ScienBiziP, P.C.

(57) ABSTRACT

A pressing apparatus includes a driving device, a platform configured to support a workpiece, a movable support mounted to the driving device, a pressing member rotatably mounted to the movable support, and a limiting block mounted on the platform. The movable support is movable in a direction substantially perpendicular to the platform. The limiting block rotates the pressing member down pressing the workpiece between the platform and the pressing member when the movable support moves.

20 Claims, 5 Drawing Sheets

PRESSING APPARATUS AND STAMP PRESS APPARATUS

CROSS-REFERENCE TO RELATED APPLICATIONS

This application claims priority to Chinese Patent Application No. 201410678753.8 filed on Nov. 24, 2014, the contents of which are hereby incorporated by reference.

FIELD

The subject matter herein generally relates to a pressing apparatus.

BACKGROUND

A pressing apparatus includes a platform, pressing block, and a driving device. The pressing block and the driving device are usually mounted above the platform.

The driving device can drive the pressing block to move in a vertical direction to press a workpiece located on the platform.

BRIEF DESCRIPTION OF THE DRAWINGS

Implementations of the present technology will now be described, by way of example only, with reference to the attached figures.

DETAILED DESCRIPTION

Figure 1:
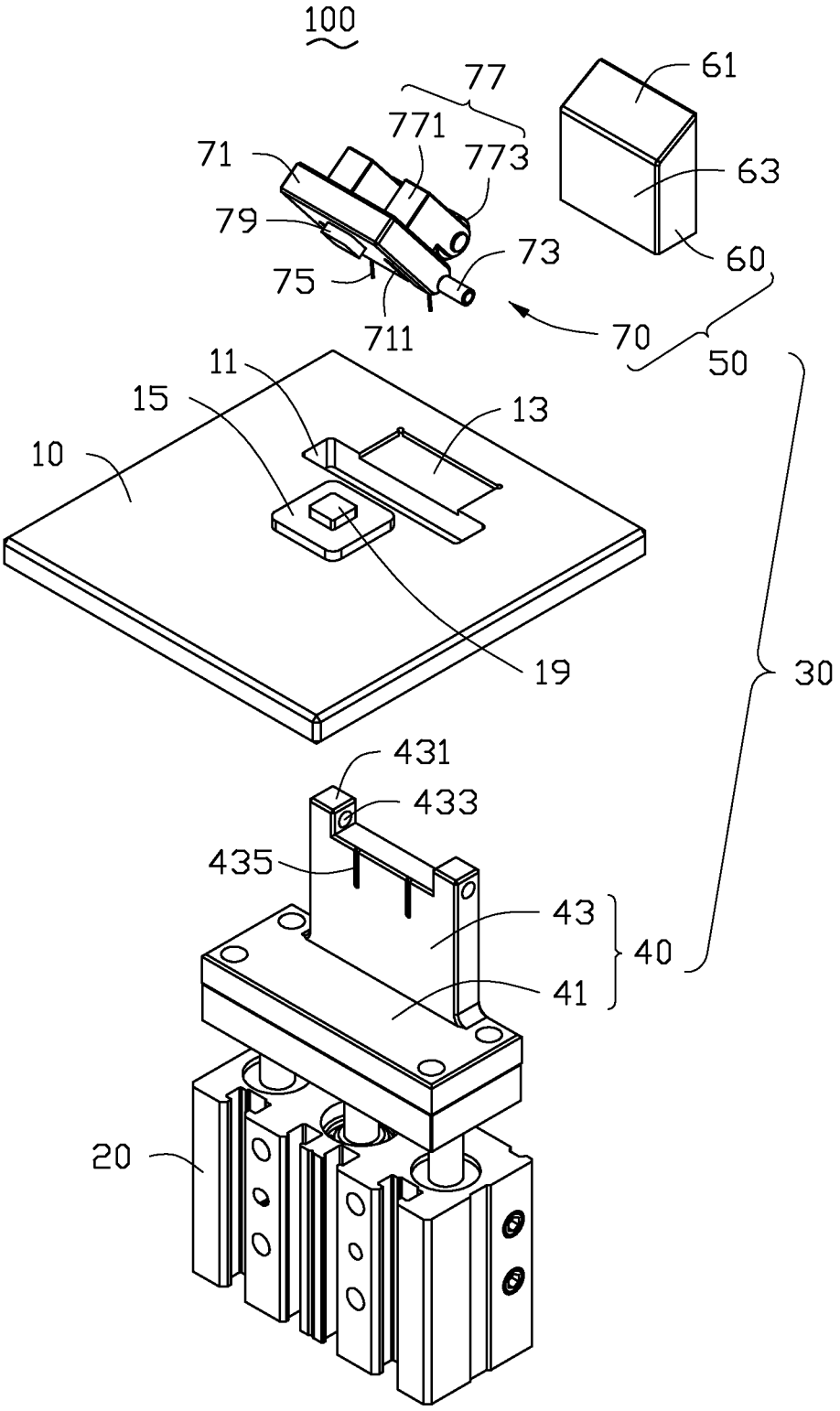
FIG. 1 is an exploded, isometric view of a pressing apparatus in accordance with an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 illustrates an embodiment of a pressing apparatus 100 including a platform 10, a driving device 20, and a pressing structure 30. In at least one embodiment, the pressing apparatus 100 is a stamp press apparatus configured to press a workpiece 19 (shown in FIG. 4) to form the workpiece 19 into a stamped shape.

The platform 10 defines a through hole 11. The platform 10 includes a mounting portion 13, a supporting portion 15 and a first die 19 mounted on the supporting portion 15. The mounting portion 13 and the supporting portion 15 are located at two opposite sides of the through hole 11. In at least one embodiment, the mounting portion 13 is a slot, the supporting portion 15 protrudes from a top surface of the platform 10.

The pressing structure 30 includes a movable support 40 and a roller mechanism 50. The movable support 40 includes a base plate 41 and a mounting plate 43 perpendicularly connected to the base plate 41. The base plate 41 is mounted to the driving device 20. Two lugs 431 extend from a top end of the mounting plate 43. Each lug 431 defines a mounting hole 433. The mounting plate 43 defines two mounting slots 435 located between the two lugs 431.

The roller mechanism 50 includes a limiting block 60 and a pressing member 70. The limiting block 60 includes a first guiding surface 61 and a second guiding surface 63 connected to the first guiding surface 61. The first guiding surface 61 is an inclined plane. An obtuse angle is defined between the first guiding surface 61 and the second guiding surface 63. The pressing member 70 includes a pressing block 71, a shaft 73, a resilient member 75 mounted to the shaft 73, and a second die 79 mounted on the pressing block 71. The pressing block 71 defines a receiving slot 711. The pressing member 70 further includes a roller assembly 77. The roller assembly 77 includes a mounting base 771 mounted on the pressing block 71 and a roller 773 mounted to the mounting base 771. The roller assembly 77 and the second die 79 are located at two opposite sides of the pressing block 71.

Figure 2:
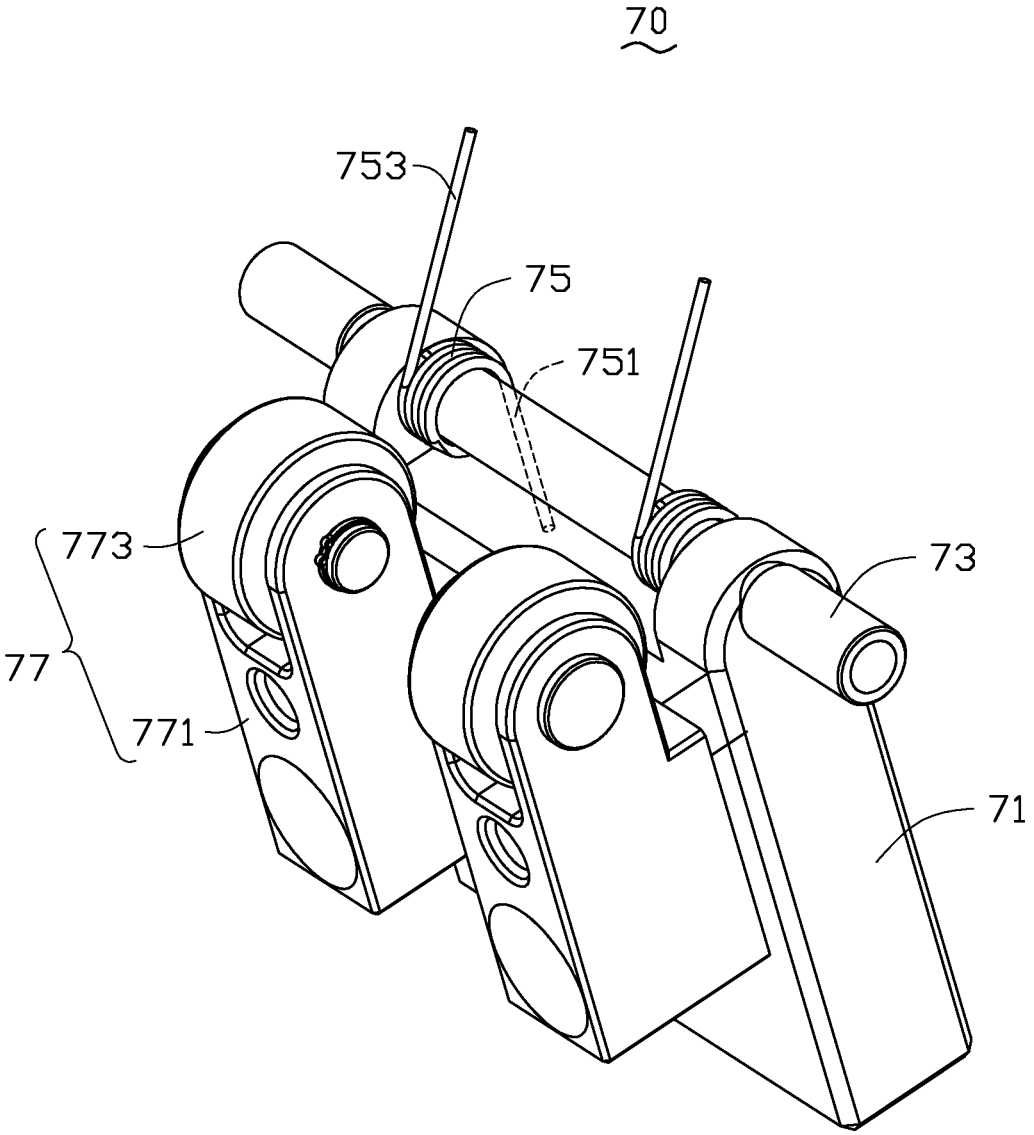
FIG. 2 is an assembled, isometric view of a pressing member of the pressing apparatus of FIG. 1.

FIG. 2 illustrates that the shaft 73 is mounted in the pressing block 71 and protrudes from two opposite sides of the pressing block 71. The resilient member 75 includes a second resilient arm 753 and a first resilient arm 751 received in the receiving slot 711. In at least one embodiment, the resilient member 75 is a coil spring.

Figure 3:
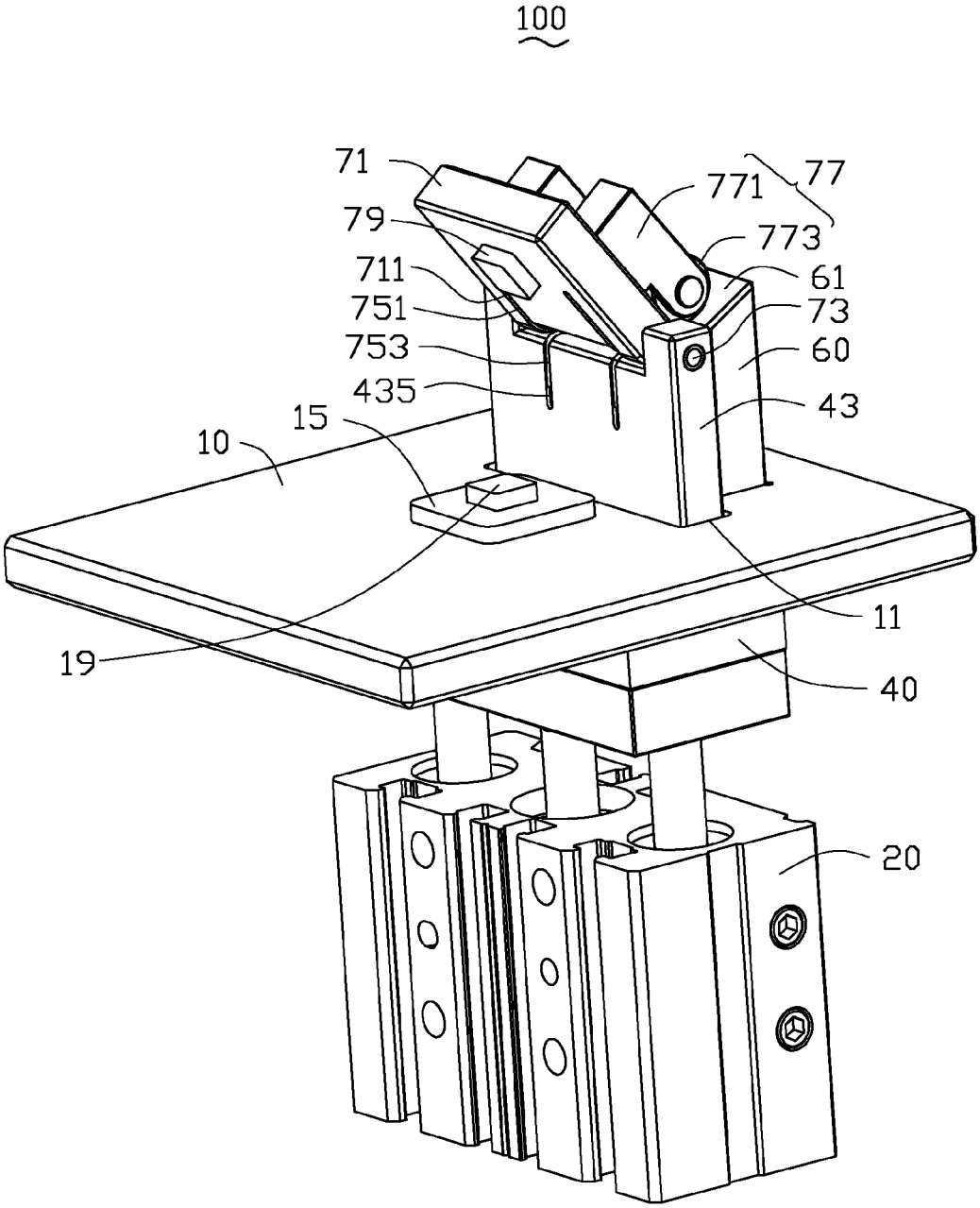
FIG. 3 is an assembled, isometric view of the pressing apparatus of FIG. 1, in which the pressing block is located at a first position.
Figure 4:
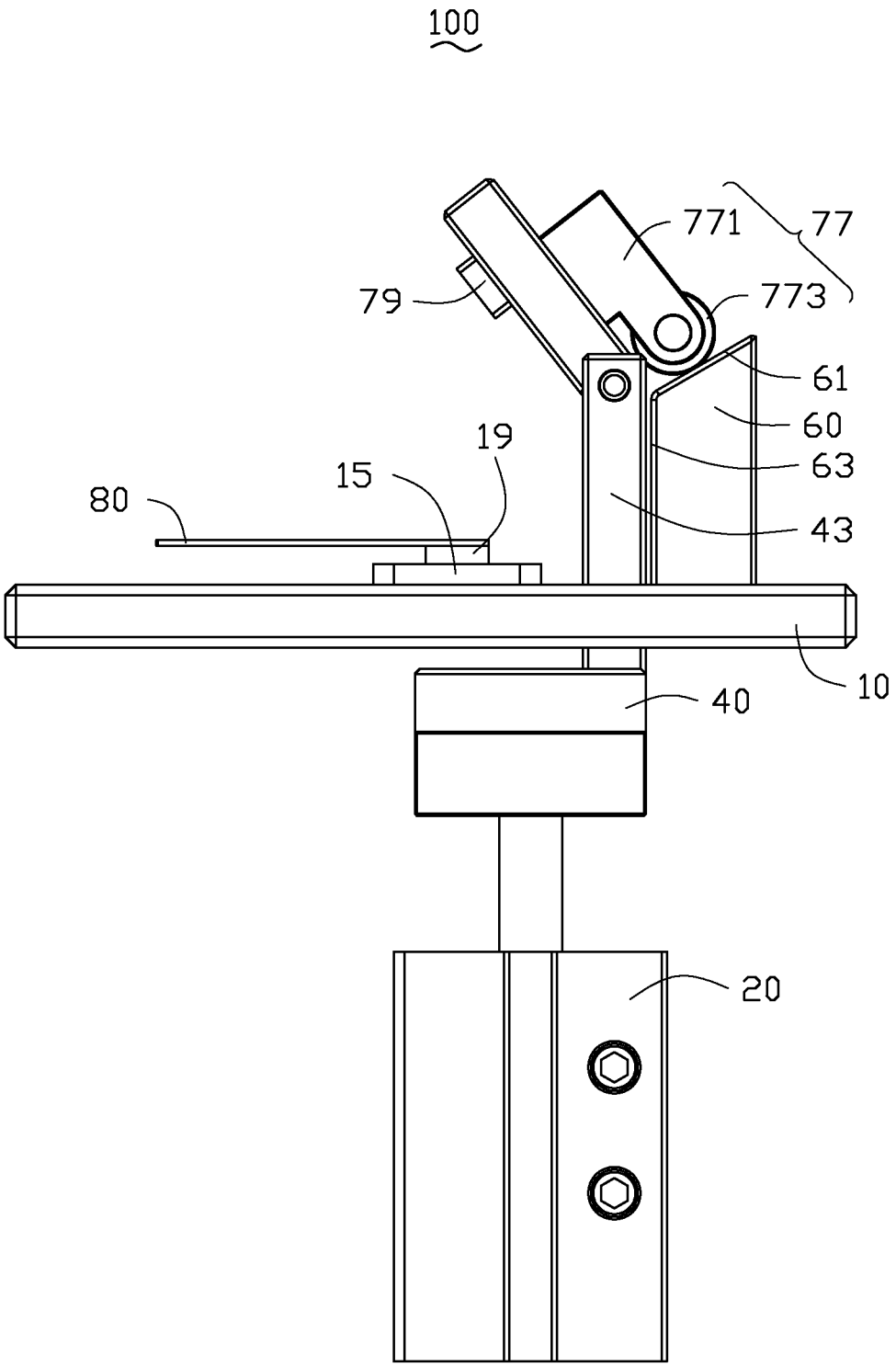
FIG. 4 is a diagrammatic front view of the pressing apparatus of FIG. 3.
Figure 5:
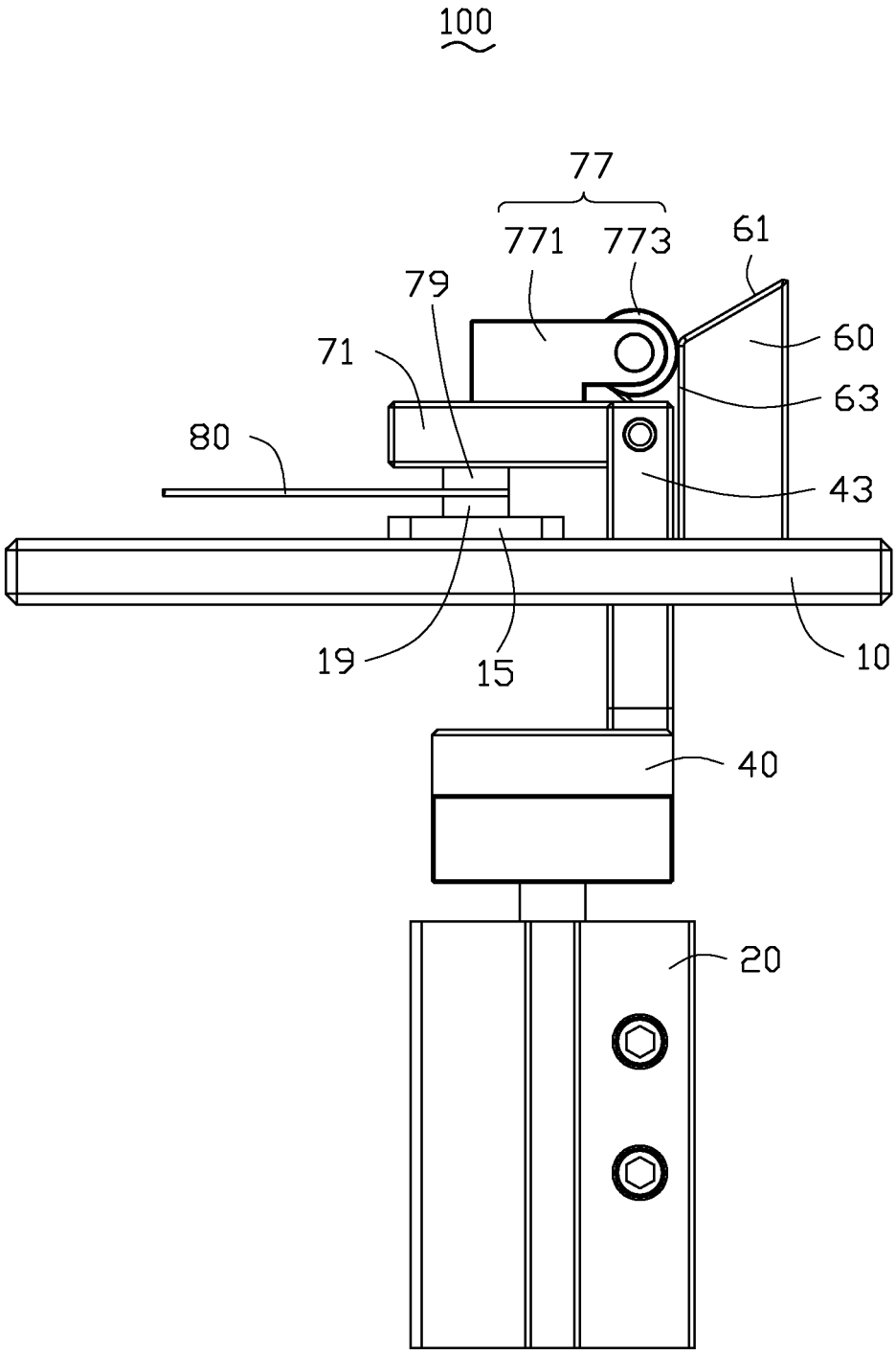
FIG. 5 is similar to FIG. 4, in which the pressing block is located at a second position.

FIGS. 3-5 illustrate an assembly of the pressing apparatus 100. The mounting plate 43 of the movable support 40 extends through the through hole 11 from a bottom of the platform 10. The movable support can move in a direction substantially perpendicular to the platform 10. The limiting block 60 is mounted in the mounting portion 13 of the platform 10. The second guiding surface 63 is substantially perpendicular to the platform 10. The shaft 73 is engaged in the mounting hole 433 so that the pressing member 70 is pivotally mounted to the movable support 40. The second resilient arm 753 is received in the mounting slot 435 of the mounting plate 43. The roller 773 abut against the first guiding surface 61. The pressing block 77 and the driving device 20 are located at two opposite sides of the platform 10. An obtuse angle is defined between the pressing block 71 and the mounting plate 43. The pressing block 71 is in a first position.

The workpiece 80 is placed on the supporting portion 15 of the platform 10 and located between the first die 19 and the second die 79. The driving device 20 starts to move the movable support 40 in the direction substantially perpendicular to the platform 10. In at least one embodiment, the movable support 40 moves downward. The roller 773 slides along the first guiding surface 61 to push the pressing block 71 to rotate. An angle between the pressing block 71 and the mounting plate 43 is decreased, and the resilient member 75 is elastically deformed by pressure by the pressing block 71. When the roller 773 slides to the second guiding surface 63, the pressing block 71 is substantially perpendicular to the mounting plate 43 and parallel to the platform 10. The pressing block 71 is in a second position.

The movable support 40 is moved in the direction perpendicular to the platform 10 by the driving device 20 till the pressing block 71 presses the workpiece 80, and the second die 79 is engaged with the first die 19 to form the workpiece 80 into a stamped shape.

The embodiments shown and described above are only examples. Many details are often found in the art such as the other features of a pressing apparatus. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A pressing apparatus comprising:

a driving device;

a platform configured to support a workpiece;

a movable support mounted to the driving device;

a pressing member rotatably mounted to the movable support; and a limiting block mounted on the platform;

wherein the movable support is movable in a direction substantially perpendicular to the platform, and the limiting block rotates the pressing member down pressing the workpiece between the platform and the pressing member when the movable support moves in the direction.

2. The pressing apparatus of claim 1, wherein the movable support comprises a mounting plate, the pressing member comprises a pressing block pivotally mounted to the mounting plate and a roller assembly mounted on the pressing block, and the roller assembly is slidable on the limiting block to rotate the pressing block.

3. The pressing apparatus of claim 2, wherein the platform defines a through hole, and the mounting plate extends through the through hole.

4. The pressing apparatus of claim 3, wherein the platform comprises a supporting portion to support the workpiece and a mounting portion to mounting the limiting block, and the supporting portion and the limiting block are located at two opposite sides of the through hole.

5. The pressing apparatus of claim 2, wherein the limiting block comprises a first guiding surface and a second guiding surface connected to the first guiding surface, and the roller assembly is slidable on the second guiding surface from the first guiding surface to rotate the pressing block.

6. The pressing apparatus of claim 5, wherein the first guiding surface is an inclined plane, the second guiding surface is substantially perpendicular to the platform, and an obtuse angle is defined between the first guiding surface and the second guiding surface.

7. The pressing apparatus of claim 2, wherein the roller assembly comprises a mounting base mounted to the pressing block and a roller mounted to the mounting base.

8. The pressing apparatus of claim 2, wherein the pressing member comprises a shaft mounted to the pressing block and a resilient member mounted to the shaft, the resilient comprises a first resilient arm and a second resilient arm, the first resilient arm abuts against the pressing block, and the second resilient arm abuts against the mounting plate.

9. The pressing apparatus of claim 8, wherein the pressing block defines a receiving slot for receiving the first resilient arm, and the mounting plate defines a mounting slot for receiving the second resilient arm.

10. A pressing apparatus of claim 2, wherein the pressing block and the driving device are located at two opposite sides of the platform.

11. A pressing apparatus comprising:

a driving device;

a platform configured to support a workpiece;

a movable support mounted to the driving device;

a pressing member rotatably mounted to the movable support; and a limiting block mounted on the platform;

wherein the driving device is configured to move the movable support in a direction substantially perpendicular to the platform, the pressing block is rotatable between a first position and a second position pushed by the limiting block when the movable support moves in the direction, an obtuse angle is defined between the pressing block and the mounting plate in the first position, and the pressing block is substantially perpendicular to the mounting plate in the second position.

12. The pressing apparatus of claim 11, wherein the movable support comprises a mounting plate, the pressing member comprises a pressing block pivotally mounted to the mounting plate and a roller assembly mounted on the pressing block, and the roller assembly is slidable on the limiting block to rotate the pressing block.

13. The pressing apparatus of claim 12, wherein the roller assembly comprises a mounting base mounted to the pressing block and a roller mounted to the mounting base.

14. The pressing apparatus of claim 13, wherein the limiting block comprises a first guiding surface and a second guiding surface connected to the first guiding surface, and the roller assembly is slidable on the second guiding surface from the first guiding surface to rotate the pressing block.

15. The pressing apparatus of claim 14, wherein the first guiding surface is an inclined plane, the second guiding surface is substantially perpendicular to the platform, and an obtuse angle is defined between the first guiding surface and the second guiding surface.

16. The pressing apparatus of claim 15, wherein the roller abuts against the first guiding surface when the pressing block is in the first position, and the roller abuts against the second guiding surface when the pressing block is in the second position.

17. The pressing apparatus of claim 11, wherein the pressing block and the driving device are located at two opposite sides of the platform.

18. The pressing apparatus of claim 12, wherein the platform defines a through hole, and the mounting plate extends through the through hole.

19. The pressing apparatus of claim 18, wherein the platform comprises a supporting portion and a mounting portion to mount the limiting block, the first die is mounted on the supporting portion, the second die is mounted on the pressing block, and the supporting portion and the limiting portion are located at two opposite sides of the through hole.

20. A stamp press apparatus comprising:

a driving device;

a platform configured to support a workpiece;

a movable support mounted to the driving device;

a pressing member rotatably mounted to the movable support;

a limiting block mounted on the platform;

a first die mounted on the platform; and a second die mounted on the pressing member and being engagable with the first die;

wherein the movable support is movable in a direction substantially perpendicular to the platform, and the limiting block rotates the pressing member down pressing the workpiece between the first die and the second die to form the workpiece into a stamped shape when the movable support moves.

* * * * *